United States Patent [19]

Long et al.

[11] 4,197,001

[45] Apr. 8, 1980

[54] PHOTOGRAPHIC PROCESSING APPARATUS WITH VARIABLE SIZED TANKS LINED WITH BAG-LIKE PLASTIC TANK INTERIORS

[75] Inventors: John G. Long, Epsom; Roy Downing, Littlehampton; Bernard P. E. Wolbarst, Epsom Downs, all of England

[73] Assignee: Durst (UK) Ltd., Epsom, England

[21] Appl. No.: 785,837

[22] Filed: Apr. 8, 1977

[30] Foreign Application Priority Data

Apr. 12, 1976 [GB] United Kingdom ..... 14859/76

[51] Int. Cl.[2] ..... G03D 3/04; G03D 13/04

[52] U.S. Cl. ..... 354/328; 354/331; 220/22.3; 220/403; 248/95

[58] Field of Search ..... 354/297, 300, 308, 309, 354/324, 328, 331, 333, 334, 335, 336, 337, 338; 220/1 T, 22.3, 23.4, 23.8, 403, 404, 408, 410, 465; 248/95, 101; 134/94, 102, 182, 183

[56] References Cited

U.S. PATENT DOCUMENTS

| | | | |
|---|---|---|---|
| 1,074,572 | 9/1913 | Norton | 354/328 |
| 2,610,759 | 9/1952 | Slade | 220/22.3 |
| 2,829,576 | 4/1958 | Debrie | 354/324 |
| 2,925,767 | 2/1960 | Hixon et al. | 354/328 |
| 2,930,306 | 3/1960 | Goodman | 354/335 |
| 2,985,333 | 5/1961 | Kirkman | 220/22.3 |
| 3,185,339 | 5/1965 | Fleming | 220/403 |
| 3,757,990 | 9/1973 | Buth | 220/404 |
| 3,893,615 | 7/1975 | Johnson | 248/95 |

FOREIGN PATENT DOCUMENTS

| | | | |
|---|---|---|---|
| 122204 | 11/1930 | Austria | 354/331 |
| 2446636 | 1/1976 | Fed. Rep. of Germany | 354/331 |

*Primary Examiner*—L. T. Hix
*Assistant Examiner*—Alan Mathews
*Attorney, Agent, or Firm*—Brumbaugh, Graves, Donohue & Raymond

[57] ABSTRACT

Photographic processing apparatus is disclosed which consists of a plurality of removable partitions mounted in a frame to form compartments. Lining bags of flexible or semi-rigid plastics sheet material are disposed in the compartments to form watertight tanks for the processing liquids into which the photographic materials to be developed are dipped. There is also disclosed a flexible or semi-rigid plastics bag for use in the apparatus which includes an integral compartment in the region of its bottom provided with perforations wherethrough agitating gas passed into the compartment can pass into the processing liquid.

7 Claims, 2 Drawing Figures

PHOTOGRAPHIC PROCESSING APPARATUS WITH VARIABLE SIZED TANKS LINED WITH BAG-LIKE PLASTIC TANK INTERIORS

BACKGROUND OF THE INVENTION

This invention concerns improvements in or relating to photographic processing apparatus. The invention is particularly although not exclusively directed to apparatus of the so-called "dip and dunk" type, wherein a battery of tanks is provided and film to be processed is sequentially passed into chemical solutions and water contained in said tanks, i.e. developers, fixers, washes etc.

Conventional processing apparatus of this type has been in use in the photographic industry for many years and has become a standard of the industry. It has however suffered from a number of disadvantages, as will be explained hereinbelow, which the invention seeks to obviate and which from the manufacturer's view point render the manufacture and maintenance of present apparatus an expensive excercise.

"Dip and dunk" type processors have comprised a plurality of narrow but deep rigid tanks, lately of metal, spun polyethylene and/or polyvinyl chloride sheets assembled together in a mounting frame to form a battery. The tanks which usually are of the same widths and depths but may be varying in lengths are filled with the necessary reagents or water for processing photographic film, and a time-controlled carrier transports the film to be processed sequentially into the reagents holding it in the reagent for periods of time predetermined in the main by the type of film involved.

The tanks, which may be reinforced, are manufactured to shape and in view of recent increases in price of raw materials in the petro-chemical and steel industry they are now very expensive. Furthermore, they can crank in transit or after some use, which requires their replacement, at concomitant expense. Another disadvantageous aspect of their use is that after having been used for certain reagents, for example bleach, they cannot thereafter be used for other reagents in view of potential detrimental action on the subsequent reagent affecting the quality of processing. Replacement is therefore necessary.

Apart from the cost of a new tank, replacing the tank, for whatever reason, also involves increasingly high labour costs, inasmuch as a substantial degree of dismantling of the apparatus is required including removal of various connections from the tank, removal of pumps for circulating the reagents, removal of heaters where installed and removal of gas burst distributing apparatus, all of which have to be reinstalled in the new tank. Moreover, these costs are incurred whether the tank is replaced by a new one, or whether it is simply removed for cleaning (itself involving similar dismantling and cost).

A further disadvantage involving the use or rigid tanks arises when it is desired to change the apparatus over to a different process or to make changes to an existing process. This may come about when for example a different brand of film is to be processed or the manufacturer of a film alters the processing specification for its film and it will usually involve altering the sequence and/or size of tanks in the apparatus. As mentioned previously the tanks may be of different sizes, say the single size, double size and triple size, which are used for holding different reagents. When the process to which an apparatus is set is to be changed, it is necessary to carry out substantial dismantling and rebuilding of the apparatus to rearrange the tanks if possible, again involving high labour costs.

It will thus be understood that the use of rigid tanks, which have become standard in the art, involves high costs and much inconvenience for both the manufacturer and the user of the apparatus.

A further disadvantageous feature of the conventional processing apparatus is the amount of labour which is necessary to build the machine initially so that it can be tested and then partially dismantled for packing and shipping. The intricasy of the known equipment imparts a labour intensive manufacture and thus the cost of manufacture is high. Furthermore being a sophisticated machine, it cannot be expected that the user will assemble the whole machine himself and it is therefore necessary to ship the machine in a partially assembled state. Apart from attracting higher transport rates by its nature, this also involves very involved, meticulous and protective packing for transport.

Because of its size, on many occasions it is necessary to further strip down the present apparatus in order to gain access to the place of installation.

From all the foregoing it will be seen that the conventional apparatus, although being satisfactory in operation, suffers from a number of costly drawbacks which in view of present price trends in labour and raw materials render the machine unattractive in terms of cost and convenience of maintenance. The present invention has therefore been evolved with the aim of improving the situation and providing a processing apparatus which may be less costly to manufacture, transport and to maintain.

SUMMARY OF THE INVENTION

According to the invention there is provided photographic processing apparatus comprising a frame, a plurality of removable partitions mounted therein to form a plurality of compartments, and lining bags of flexible or semi-rigid plastics sheet material disposed in said compartments to form tanks for the processing liquids.

Thus the disadvantages associated with the use of rigid tanks as discussed above are immediately overcome by the use of bags of flexible or semi-rigid plastics sheet material, which are supported to maintain their form and against bursting by the said partitions. As is well known, such sheet material, for example polyvinyl chloride sheet or polyethylene sheet is comparatively inexpensive and easy to manufacture, and in view of this the liners become disposable. Thus should a fracture occur in the liner, or a compartment is required to hold a different chemical, or a liner requires cleaning, all that is required for the user to do is to empty the liner of its contents, remove it from the apparatus for disposal and replace it with a new liner. The present expensive tank manufacturing costs and the high labour costs associated with dismantling the apparatus when rigid tanks are involved are avoided. By this expedient therefore, manufacture and operation are substantially simplified with a corresponding reduction in costs.

As mentioned above the partitions are removable, and they will preferable be laminar. The frame will preferably be substantially rectangular in horizontal cross section such that the compartments also become rectangular in section. In a particularly preferred embodiment the removable partitions are selectively positionable in the frame so as to permit a desired sequence of differently sized tanks to be obtained. This is a particularly preferred feature of the invention, because when it is desired to change the processing sequence as mentioned above, all that is required for the user to do is to remove the liners, remove the partitions and replace them in an order which provides the modified sequence and then to replace or renew the liners. As constrasted with the previous practice of dismantling rigid tanks, possibly purchasing new tanks of a different size, and rebuilding the machine with the tanks in a different order, the savings in terms of flexibility, time convenience and cost are substantial.

Another main preferred feature of the invention comprises making the frame and partitions readily dismantlable. The advantage of this in terms of transport costs will immediately be apparent, since this feature enables the tank battery of the apparatus to be packed in the form of a stack of components, and shipped as basic material, at a correspondingly lower cost than has previously been the case where machines have needed to be shipped whole in view of their difficulty of reassembly. Again, the provision of rigid tanks involves a high volume for shipping, attracting extra cost, whereas the fact that this preferred feature of the invention enables not only the flexible liners to be shipped flat but also the main structural components of the machine, means that substantial savings are also made here.

The main frame itself need be only a relatively simple structure, facilitating assembly or dismantling. As such machines in the past have necessarily been built in the factory to the user's specification, the machine according to the invention and including the hereinbefore mentioned preferred features can readily be assembled on site to the end user's specification, since what basically is required is that the main frame be put together, partitions be inserted to provide compartments as required, and place into the compartments the flexible lining bags as aforesaid and connect the other parts of the equipment to effect a finished processor. Thus according to this aspect of the invention it becomes no longer necessary to build a machine to a user's specification, but merely to send the components to enable the user to put together his own. If desired, a range of partitions and frame members can be delivered to enable a variety of sizes and sequences of machine to be built.

In a preferred embodiment of the invention the main frame comprises two end plates joined and secured together by a plurality of rods. By such a construction it is possible to easily provide different sizes of machine by the simple expedient of supplying sets of rods of differing lengths. The rods may for example be secured to the end plates by having threaded end portions which pass through registering apertures in the end plates, nuts being bolted on from the outside, but other means of fixing will be readily apparent.

The partitions may be made from any rigid sheet material such as metal, (e.g. steel), chipboard, blockboard or even plastics, but plywood is the presently preferred material, and it may be coated with plastics or any other suitable finish. At their upper end, means such as raised flanges may be provided for securing the open mouths of the plastics liners. The edges of the liners may for example be folded over said flanges and be fixed thereto by means of clips.

The sidewalls of the compartments may if desired be provided by a continuous side wall as part of the main frame, provided at suitable spacings with means for securing the removable partitions, but preferably a plurality of side wall and base members are provided each comprising the side wall and base of a single compartment. The advantage of this arrangement is that side wall and base members in a plurality of sizes may be supplied, so that when it is desired to create any processing sequence the side wall and base members are repositioned as necessary and the partitions replaced. This leads to another preferred feature of the invention which is that the side wall and base members can be provided with flanges which engage in grooves formed in the edges of the partitions.

The side wall and base members will preferably be made of metal such as mild steel, coated with plastics or other suitable surface finish as required, and be provided with apertures as necessary to receive inlet and overflow pipes, draining connections and the like.

In certain circumstances a user may wish at times to use lesser amounts of developing solutions than at others. If for example a comparatively small quantity of film is to be processed at a given time, it would be uneconomic to fill the apparatus to its usual working capacity, but in the hitherto known machines, it has been essential to fill them in order to function properly. This difficulty is overcome in a preferred embodiment of the invention, wherein the side wall members are provided with a plurality of apertures for receiving connections from said bags at a plurality of levels, thus enabling lining bags of different sizes to be accommodated. Thus, blocks or other spacer members may be positioned at the bottom of said compartments to support the bases of lining bags which are of appreciably lesser depth than the compartments, and the provision of said plurality of apertures will ensure that outlets are available for the necessary bag connections.

The invention also extends to the plastics liner in itself and thus, viewed from another aspect, the invention provides a bag of flexible or semi-rigid plastics material for use as a liner in photographic processing apparatus as aforesaid, comprising bottom and side walls and including an integral compartment in the region of the bag bottom adapted to be supplied with gas and provided with perforations to enable bubbles of gas to be passed into liquid contained in the bag in use. This bubbling agitation is required in processing and was previously provided by a special manifold passed into the hitherto conventional rigid tanks.

The lining bags may be provided with inlet, drain and overflow connections which may be conveniently welded into the walls of the bag. Such connections may be adapted to pass through apertures formed in the side wall and/or base members as hereinbefore mentioned. Another preferred feature of lining bags according to the invention is the provision of a partition wall along the major part of the length of the bag substantially providing an end compartment. If included, in this compartment can be placed a heater and/or impeller and/or thermostat to agitate and/or circulate and/or filter liquid contained in the bag and/or maintain its temperature constant. The partition wall which may be adhered by welding, adhesive or otherwise to the walls of the bag as well as being formed integrally may extend just short of the bottom of the bag and of the mouth in order to allow circulation of the liquid. Alternatively, the partition wall may be sealed to the bottom of the bag to provide a separate compartment into which liquid from the main body of the bag may only flow by way of passing over the upper edge of the partition wall in the manner of a weir, the separate compartment thus forming an outlet chamber.

DESCRIPTION OF THE PREFERRED EMBODIMENT

Figure 1:
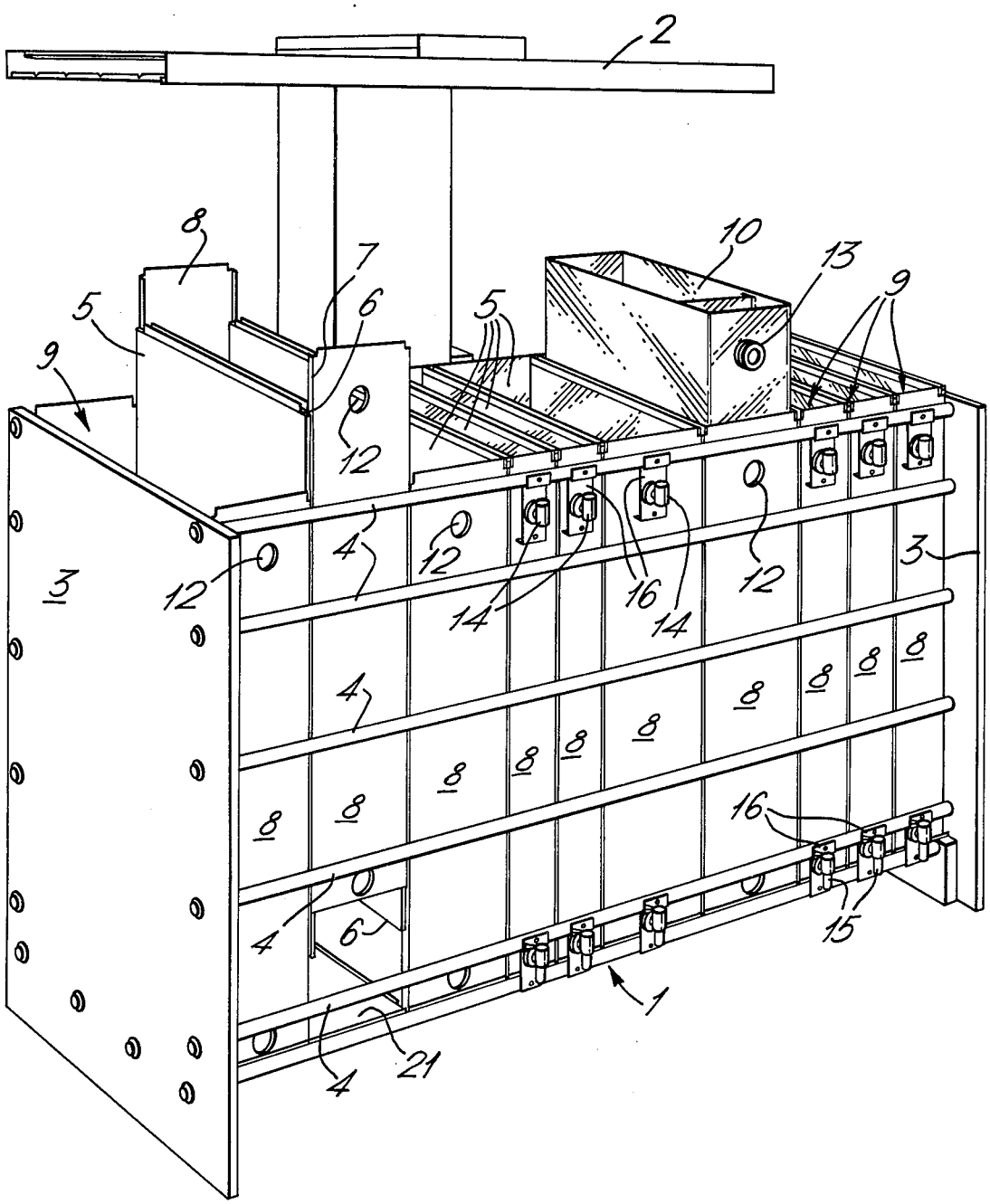
FIG. 1 is a perspective view of an embodiment of the processing apparatus.

Referring to the drawings, there is shown a photographic processing apparatus of the "dip and dunk" type comprising a battery of reagent-holding containers 1 and a carrier 2. The carrier is of conventional construction and will not herein be described further.

The apparatus comprises a mounting frame which consists of end plates 3 held together by rods 4 which are fixed to the end plates 3 as shown. Within the framework thus provided are disposed a plurality of removable partitions 5 made of plywood. These partitions have along each side and base edge longitudinal groove 6 into which engage upturned flanges 7 of end wall members 8 and base members 21 which are made of pressed steel.

There are thus formed a plurality of container-receiving compartments 9 into which are placed lining bags 10 which will be described in further detail hereafter. The free edges of the mouths of lining bags 10 are folded over the upturned flanges 11 formed on the upper edge of the partitions 5 and secured thereto by means of clips 22, as shown in detail in FIG. 2.

It will be noted that the end wall members 8 and base members 21 have varying lengths (the length of these members being their dimension in the longitudinal direction of the overall apparatus as shown in FIG. 1). FIG. 1 illustrates the first three wall members 8 and their associated base members 21 (counting from the left end of the apparatus) twice as long as the following two sets of members 8 and 21. The first three compartments are of correspondingly greater size than the following two, as shown. This is because a particular processing sequence has been selected. In order to alter this sequence all that is necessary is to remove the partition 5 replace the end wall members 8 and base members 21 in a different order and then replace the partitions 5 correspondingly. Thus in a very short space of time indeed it is possible to modify the processing sequence without the necessity for intricate dismantling and rebuilding of the apparatus as has been required by the prior art.

The end wall members 8 are formed with apertures 12 to receive therethrough connections 13 and base members 21 to receive therethrough connections 19 which are provided on the lining bags 10 for reagent supply, draining gas flow and overflow purposes. Overflow members 14 or drain taps 15 can be mounted in the connections in a conventional way and be secured to the mounting frame by means of brackets 16.

Figure 2:
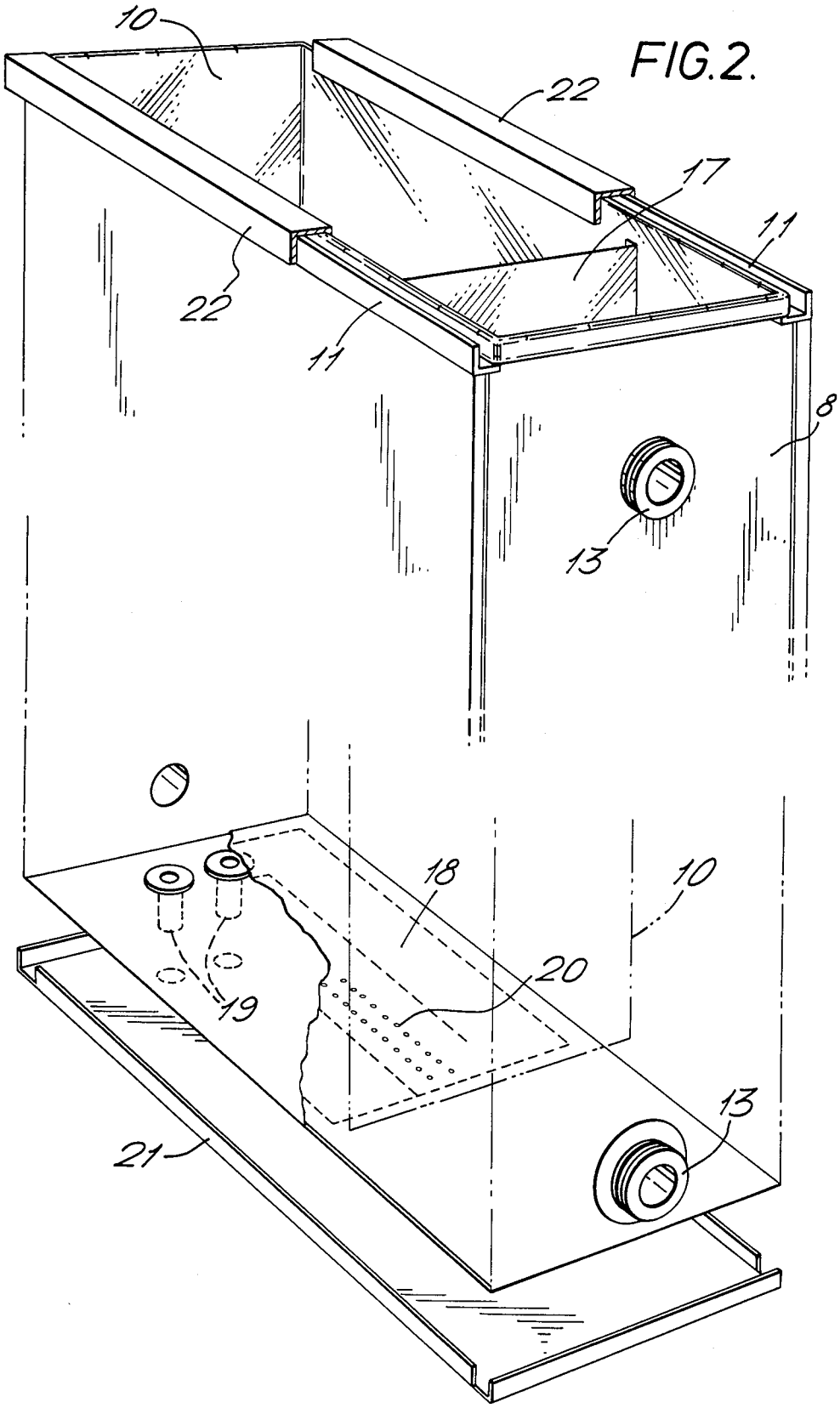
FIG. 2 is a perspective view of an embodiment of lining bag.

Referring now more particularly to FIG. 2, the lining bag depicted is constructed of flexible polyvinyl chloride provided with welded connections 13 as mentioned above. Welded to the interior walls of the bag, a partition wall, indicated in FIG. 2 by the numeral 17, extends from just short of the open mouth of the bag to just short of its base. The base is provided with an integral chamber 18 which is adapted to receive gas for agitating by means of supply connection 19. The wall of the chamber is provided with perforations 20 to provide streams of gas bubbles for agitating the reagent contained in the bag.

Whilst the lining bags 10 are flexible and would in the absence of any support tend to expand when filled with liquid, this is prevented, and their form is maintained, by the partitions 5 and when filled with liquid they will assume a substantially rectangular shape as defined by the combined partitions 5 and end wall members 8 and base members 21.

Where the apparatus in the collapsed and packed state is likely to be subjected to extremely low temperatures such as are encountered in the cargo holds of aircraft, the flexible polyvinyl chloride bags might become brittle and be subject to fracture. In these applications semi-rigid bags of say 1/16 inch thick polypropylene may be used which have better resistance to brittleness damage at such low temperatures.

It will be seen that it is a simple matter to dismantle this apparatus. All that is required is that the connections be freed from their mountings and the flexible lining bags removed, the partitions and end wall and base members be removed from the mounting frame which is itself easily dismantled by disconnecting the rods 4 from the end plates 3. The apparatus can then be stacked flat, taking up a mere fraction of its operational size. Furthermore, the flexible lining bags can be replaced in the apparatus at a substantially lower cost than the rigid tanks used hitherto and the operational sequence of the apparatus can be modified with minimal labour.

What is claimed is:

1. Photographic processing apparatus comprising:

a frame, a plurality of removable partitions mounted in said frame and defining a plurality of compartments, and lining bags of at least partially flexible plastic sheet material disposed in said compartments to form separate tanks for the processing liquids, the lining bags having walls and at least one fluid connection fixed into said walls.

2. Apparatus as set forth in claim 1 in which said removable partitions are selectively positionable in said frame so as to permit a desired sequence of differently sized tanks to be obtained.

3. Apparatus as set forth in claim 1 including a plurality of end wall members and a plurality of base members each comprising respectively the end wall and base of a single compartment.

4. Apparatus as set forth in claim 3 in which the end wall members and the base members are provided with flanges which engage in grooves formed in the edges of said partitions.

5. Apparatus as set forth in claim 3 in which the end wall members are provided with a plurality of apertures for receiving fluid connections from said bags at a plurality of levels.

6. Apparatus as set forth in claim 3 wherein at least one of the base and end wall members forming a compartment has at least one aperture formed therein, and the bags have said at least one fluid connection thereon positioned for alignment with said aperture.

7. For photographic processing apparatus according to claim 1, the lining bag comprising bottom and side walls and including an integral compartment in the region of the bag bottom adapted to be supplied with gas and provided with perforations to enable bubbles of gas to be passed into liquid contained in the bag in use, the bag having inlet, drain and overflow connections fixed into the walls of the bag, a partition wall along the major part of the length of the bag substantially providing an end compartment, the bag being collapsible and adapted to fit into a compartment in the photographic processing apparatus, and said photographic processing apparatus having openings therein at locations corresponding to at least some of said connections.

* * * * *